US009238380B2

(12) United States Patent
Ogimura

(10) Patent No.: US 9,238,380 B2
(45) Date of Patent: Jan. 19, 2016

(54) SERIAL INKJET PRINTER

(71) Applicant: SEIKO EPSON CORPORATION, Tokyo (JP)

(72) Inventor: Takafumi Ogimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/656,889

(22) Filed: Mar. 13, 2015

(65) Prior Publication Data

US 2015/0258825 A1 Sep. 17, 2015

(30) Foreign Application Priority Data

Mar. 14, 2014 (JP) ..... 2014-051290

(51) Int. Cl.
*B41J 23/00* (2006.01)
*B41J 25/34* (2006.01)

(52) U.S. Cl.
CPC . *B41J 25/34* (2013.01); *B41J 23/00* (2013.01)

(58) Field of Classification Search
CPC ..... B41J 25/308; B41J 29/393; B41J 11/005; B41J 2/515; B41J 25/005
USPC ..... 347/8, 16, 37, 101, 104
See application file for complete search history.

(56) References Cited

U.S. PATENT DOCUMENTS 5,859,653 A * 1/1999 Aoki et al. ..... 347/8
7,931,348 B2 * 4/2011 Kida ..... 347/19
8,567,905 B2 * 10/2013 Ogasawara ..... 347/37

FOREIGN PATENT DOCUMENTS

JP 2005-262832 A 9/2005

* cited by examiner

*Primary Examiner* — An Do
(74) *Attorney, Agent, or Firm* — Global IP Counselors, LLP

(57) ABSTRACT

A serial inkjet printer includes a recording head having a plurality of nozzles between which a pitch is X inches, a carriage, a first roller pair, and a second roller pair. The first roller pair is configured to move a medium at an upstream side of a conveyance direction of the medium relative to the recording head, and includes a drive roller with a hollow structure and a driven roller. A circumferential length Y of the drive roller is 2 to 4 inches. When a length along the conveyance direction of a row formed by the nozzles is Z inches, Y is greater than Z. While repeating scanning of the recording head and conveying of the medium, recording is performed in band units at a printing speed of 20 to 30 ipm, and stop error precision of the medium during conveyance is X/2 inches or less.

4 Claims, 2 Drawing Sheets

SERIAL INKJET PRINTER

CROSS-REFERENCE TO RELATED APPLICATIONS

This application claims priority to Japanese Patent Application No. 2014-051290 filed on Mar. 14, 2014. The entire disclosure of Japanese Patent Application No. 2014-051290 is hereby incorporated herein by reference.

BACKGROUND

1. Technical Field

The present invention relates to a serial inkjet printer. The inkjet printer of this application includes types such as copy machines, fax machines and the like.

2. Related Art

From the past, inkjet method printers have been widely used for applications such as copying and printing (Unexamined Patent Publication No. 2005-262832). Recently, there is also a demand for printers that are for use at offices yet can print at even higher speed. It is necessary to increase the conveyance speed to meet that kind of acceleration need. However, when the conveyance speed is increased, there is the problem of noise generated by the conveyance roller. Recently, the environmental awareness of users has increased, and there is a demand for consideration of the environment for office equipment as well. As an eco label regulating equipment noise and the like, The Blue Angel and the like are known, for example.

However, with conventional inkjet printers, recording is performed by media being nipped respectively by a pair of conveyance rollers further to the upstream side in the media conveyance direction than the head, and by pair of paper ejection rollers at the downstream side. The pair of conveyance rollers is constituted by a drive roller that is driven by a motor, and a driven roller driven by the drive roller, and typically, the circumference length of the conveyance drive roller is matched to the conveyance direction length (band height) of a nozzle row for discharging ink, in order to eliminate the effect of roller eccentricity error.

To print at high speed, with the roller diameter kept fixed, when the rotation count of the conveyance roller is increased, noise increases. In light of that, by making the roller diameter larger, it is also possible to reduce the noise by lowering the roller rotation count while maintaining the necessary conveyance speed. However, in the case of a serial printer, each time the carriage is scanned once, it is necessary to rotate the conveyance roller and move the media, and as the conveyance roller stop position precision affects the recording quality, when the roller diameter is made too large, there is the risk that it will not be possible to stop the media with sufficient precision due to the inertia of the roller.

SUMMARY

The present invention is created considering the issues noted above, and an object is to provide an inkjet printer that is able to stop the media with sufficient precision while reducing the noise of the conveyance roller generated during conveyance of the media.

To achieve the object noted above, a serial inkjet printer of a first mode is equipped with a recording head having a plurality of nozzles between which a pitch is X inches, a carriage configured to move the recording head, a first roller pair configured to move a medium at an upstream side of a conveyance direction of the medium relative to the recording head, and a second roller pair configured to move the medium at the downstream side of the conveyance direction relative to the recording head. The first roller pair includes a drive roller and a driven roller, the drive roller has a hollow structure, and a circumferential length Y of the drive roller is 2 to 4 inches. When a length along the conveyance direction of a row formed by the plurality of the nozzles is Z inches, Y is greater than Z. While repeating scanning of the recording head and conveying of the medium, recording is performed in band units at a printing speed of 20 to 30 ipm, and stop error precision of the medium during conveyance is X/2 inches or less.

BRIEF DESCRIPTION OF THE DRAWINGS

Referring now to the attached drawings which form a part of this original disclosure.

DETAILED DESCRIPTION OF EXEMPLARY EMBODIMENTS

Following, we will describe modes for carrying out the invention based on the drawings. For the same constitutions with each embodiment, the same code number will be given, descriptions will be given only with the initial embodiment, and a description will be omitted for that constitution with the embodiments thereafter.

Figure 1:
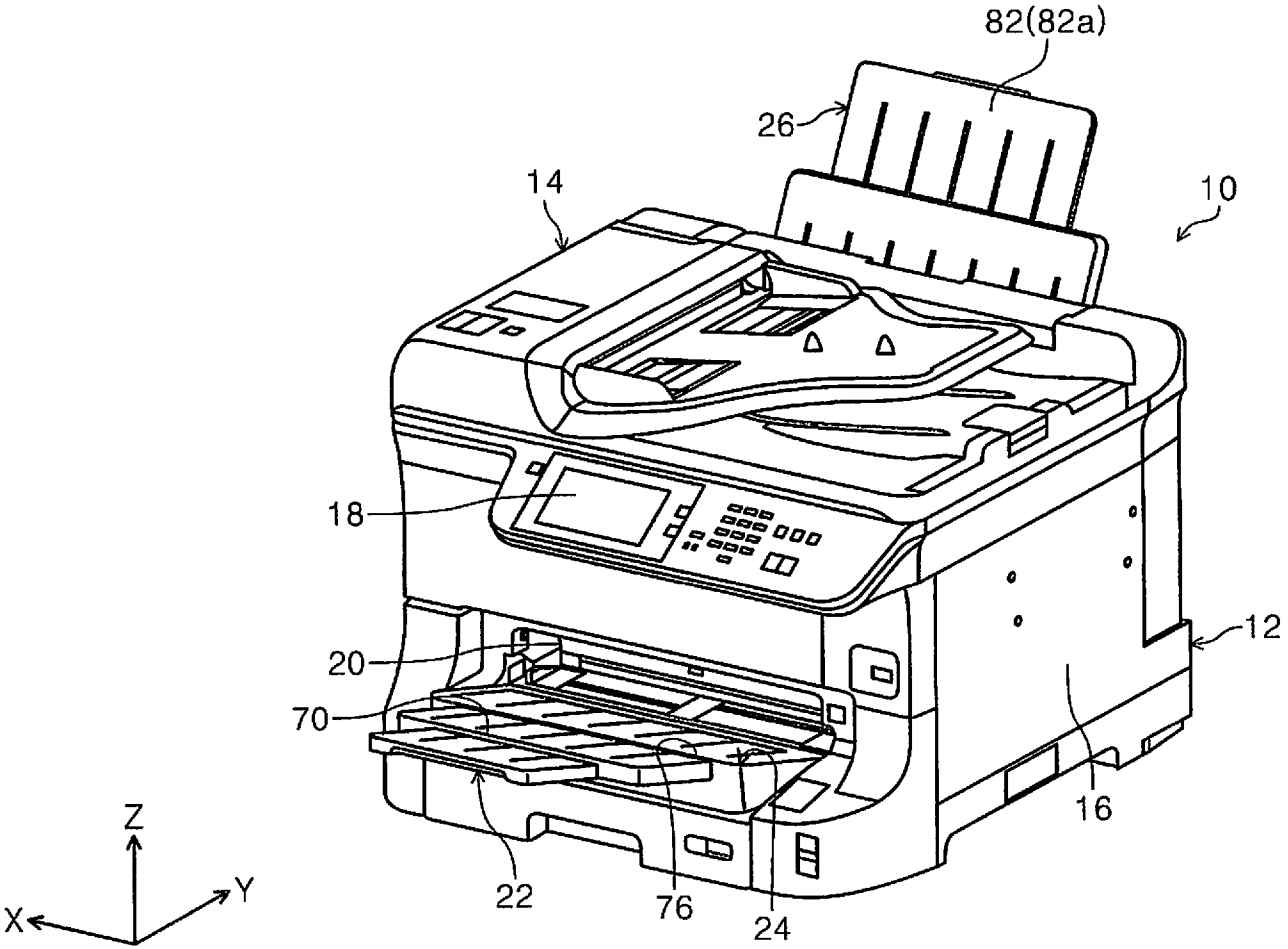
FIG. 1 is a perspective view of the printer of the present invention.
Figure 2:
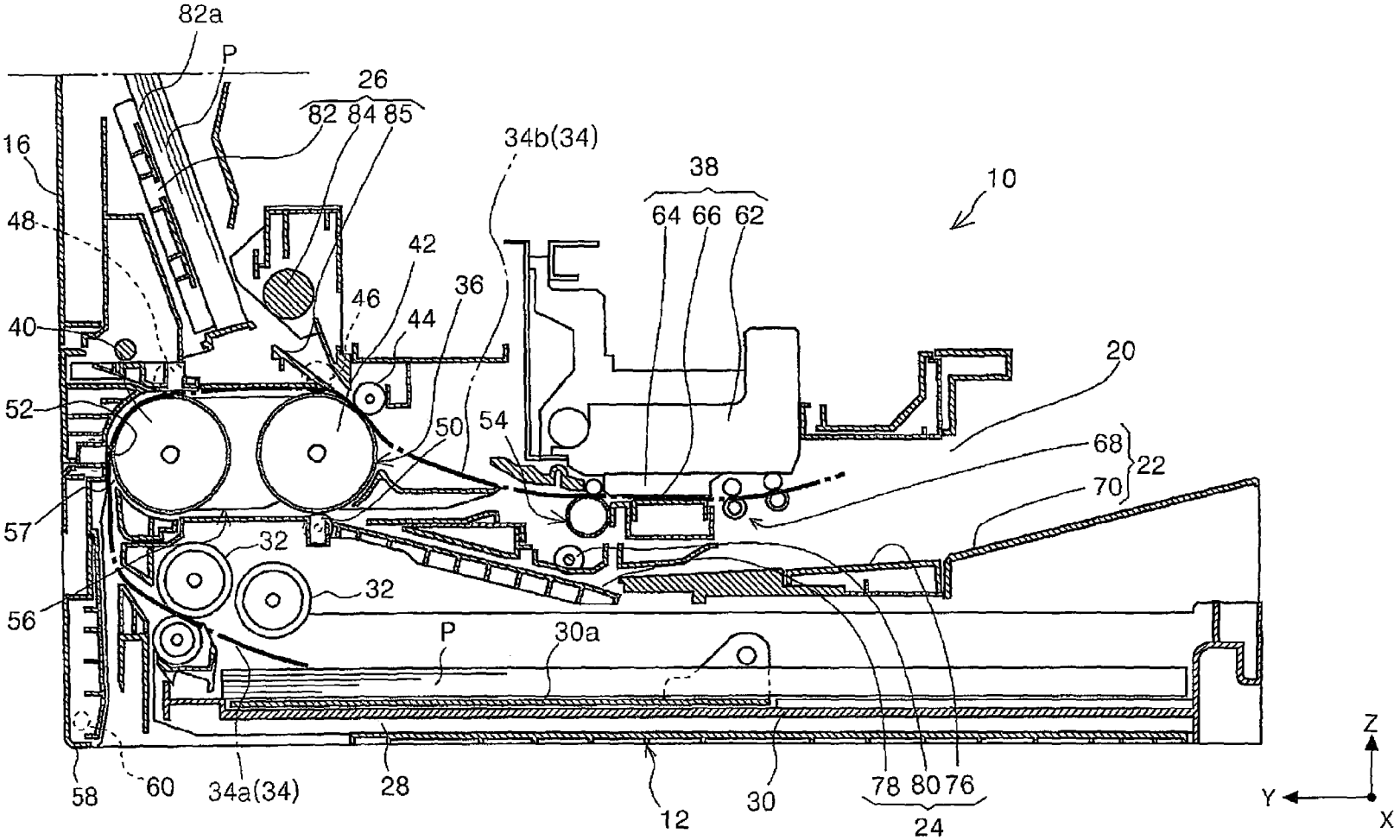
FIG. 2 is a side cross section view showing the media conveyance path from the media housing unit with the printer of the present invention.

FIG. 1 is a perspective view of the printer of the present invention, and FIG. 2 is a side cross section view showing the media conveyance path from the media housing unit with the printer of the present invention.

Overview of the Printer

Referring to FIG. 1 and FIG. 2, we will describe the constitutional elements of an inkjet printer 10 (hereafter referred to as "printer 10") as an example of the recording device. The printer 10 is equipped with a device main unit 12 as the "media conveying device" and an image reading device 14. The device main unit 12 is equipped with a housing 16 that constitutes the exterior, an operating unit 18 provided on the front surface of the housing 16, and an opening part 20 formed on the front surface side of the device main unit 12 (−Y axis direction on FIG. 1).

The image reading device 14 is constituted to be able to open and close on the top part of the device main unit 12 with the back surface side of the device main unit 12 (+Y axis direction side in FIG. 1) as the fulcrum point of the rotation axis. Also, the operating unit 18 is constituted equipped with a power supply button or print setting button, a display panel or the like for operating the printer 10.

Also, provided on the opening part 20 on the front surface side of the device main unit 12 are an exhaust unit 22 of paper P (see FIG. 2) as the "media" on which a recording process is executed from within the device main unit 12, and a front surface manual insertion unit 24 as a "first supply unit" for supplying the paper P into the device main unit 12 from the front surface side of the device main unit 12. Also, on the top part of the front surface side of the device main unit 12 (+Y axis direction side in FIG. 1) is provided a back surface feed unit 26 as a "second supply unit." Also, as shown in FIG. 2, provided on the printer 10 is a media housing unit 28 (illustrated in FIG. 2) as a "third supply unit" positioned at the Z axis direction downward side of the device main unit 12.

A recording head 64 is fixed to a carriage 62 and while being moved in the main scan direction, is made to perform recording on media by discharging ink at a fire timing of designated intervals. On the nozzle plate of the recording head, a nozzle row is formed with a plurality of nozzles (not illustrated) extending in the media conveyance direction. It is also possible to equip one or a plurality of nozzle rows for each discharged ink color, or to provide a plurality of nozzle rows for the color used often, such a black or the like. Also, by aligning two rows of the same color nozzle row, and skewing the rows to each other by a half pitch in the sub scan direction orthogonal to the main scan direction (said another way, the media conveyance direction) it is possible to obtain the effect of doubling the resolution of the sub scan direction. As another mechanism for increasing the resolution, it is possible to increase the actual resolution on the media by arranging the nozzle rows at a diagonal in relation to the sub scan direction. With that kind of diagonally arranged head, we will suppose a virtual line is drawn along the sub scan direction on the recording head, and a line is extended in the main scan direction from each nozzle in relation to that line. In such a case, with the pitch of the nozzles projected on the virtual line, we would be able to observe that to be tighter than the interval of the actual nozzle pitch arranged diagonally (=means that the arrangement makes it possible for higher resolution printing than the pitch between nozzles in the nozzle row direction). In the case of a printing method with which a plurality of roller pairs is provided upstream and downstream in the conveyance direction sandwiching the recording head, the media is nipped by the respective roller pairs, and recording is performed with the interval between the media and the recording head kept constant, there is the risk of media that became wavy due to ink discharge being worn by the head, so it is preferable that the length of the nozzle row sub scan direction be 2 inches or less. From the perspective of printing speed, it is preferable to make that length 1 inch or greater.

With this embodiment, with the nozzle row having a sub scan direction length of 1.33 inches, the printer is able to print the media at a printing speed of 20 to 30 ipm (defined by ISO standards). It is also possible to not have the printing speed be fixed, and to make it possible to print at a slower printing speed when in a higher image quality mode, and to print at a higher printing speed when in a lower image quality mode. Specifically, that printing speed can be an item used for at least one mode among a plurality of speed modes.

With this embodiment, using the nozzle row length as one unit, it is possible to repeat conveyance of the media for each of those units, and to print the media printing area for each of those units, realizing so-called "band unit" printing, and thus to achieve the printing speed in the range noted above. ("Band unit" printing noted here includes a printing method by which printing is performed only with spare nozzle groups excluding end part nozzles, without end part nozzles included in one nozzle row being provided for printing, and conveying is repeated by the height of that nozzle group during media conveyance).

Media Housing Unit and Media Conveyance Path from the Media Housing Unit

Referring to FIG. 2, we will describe each constitution of the printer 10 and the conveyance path of the paper P from the media housing unit 28.

The media housing unit 28 is equipped with a paper feed cassette 30. The paper feed cassette 30 is constituted so as to be able to be mounted on and removed from the mounting front side (−Y direction side in FIG. 2) on the device main unit 12. Above the paper feed cassette 30 are provided feed rollers 32, 32 rotationally driven by a rotation source (not illustrated). Also, a bottom plate 30*a* of the paper feed cassette 30 is constituted as a hopper that supports the paper P and energizes the paper P on the feed roller 32 positioned in the +Z axis direction in FIG. 2.

Also, the dot-dash line to which code number 34 is given in FIG. 2 indicates the media conveyance path 34 of the paper P conveyed from the media housing unit 28. The media conveyance path 34 of this embodiment is equipped with a media supply path 34*a* up to the conveyance unit 36 from the media housing unit 28, and a media conveyance path 34*b* up to the exhaust unit 22 via at least a portion of the media conveyance path with the conveyance unit 36 described later.

When feeding the paper P stored in the paper feed cassette 30 to the downstream side of the media conveyance path 34, by the feed roller 32 touching the topmost item of the paper P housed in the paper feed cassette 30 and rotating, that topmost paper P is sent from the paper feed cassette 30 to the conveyance unit 36 along the media supply path 34*a*. Then, the paper P sent from the media housing unit 28 in FIG. 2 along the media supply path 34*a* by the feed roller 32 is conveyed along the media conveyance path 34*b*, and reaches the exhaust unit 22 via at least a portion of the media conveyance path with the conveyance unit 36 described later and a recording unit 38.

With this embodiment, the conveyance unit 36 is equipped with a roller 40 and a roller 42, a first conveyance driven roller 44, a second conveyance driven roller 46, a third conveyance driven roller 48, a fourth conveyance driven roller 50 and a fifth conveyance driven roller 52, a roller pair 54 as the "conveyance rollers" (the lower side roller is a drive roller connected via a drive source and train wheel such as gears or the like (not illustrated), and the upper side roller is a driven roller; the drive and driven relationship can also be reversed), and a curved part 57 that inverts the paper P sent in the reverse with the reverse transmission path by the pair of conveyance rollers 54 using the outer circumference surface of the roller 40. Also, the roller 40 and the roller 42 are constituted as a unit body 56 that is detachable with the device main unit 12.

The unit body 56 can be detached with the device main unit 12 from the +Y axial direction side in FIG. 2 when the back surface cover 58 is rotated in relation to the device main unit 12 in the +Y axial direction in FIG. 2 with the rotation axis 60 (see FIG. 2) as the rotation fulcrum, and has the back surface cover 58 in a state open in relation to the device main unit 12 (not illustrated). Also, with this embodiment, the roller 40 and the roller 42 are respectively rotationally driven in the clockwise direction in FIG. 2 by a common drive source (not illustrated) when the unit body 56 is attached to the device main unit 12 and the back surface cover 58 is in a state closed in relation to the device main unit 12.

With this embodiment, the driver roller which is one of the rollers forming the driver roller pair 54 has a hollow structure with the goal of reducing inertia. If the circumferential length of the drive roller is made longer than the length of the nozzle row along the sub scan direction, the sound generated from the conveyance roller will be less than when those are the same length, but in the printing speed range of 20 to 30 ipm, if that circumferential length is 2 to 4 inches, it is also possible to prevent skewing of the media stop position due to the effect of inertia while preventing the noise of the conveyance roller from being too great. The stop error prevents white streaks or stripe form concentration unevenness, so it is preferable to suppress the nozzle pitch to ½ or less.

When the drive source of the drive roller is a DC servo motor, a controller (not illustrated) in charge of the operation of the printer of this embodiment (by executing software on a CPU, an entity that executes a designated operation, an entity consisting of hardware such as ASIC or the like is possible)

references signals output from an encoder (the attachment position is a motor axis, roller axis or the like that is the drive source) rotated synchronously with the conveyance roller, and it is necessary to suppress the inertia to within a range that feedback control is possible based on the error between the target rotation position for control and the actual rotation position, but with the constitution of this embodiment, it is possible to suppress the inertia to a range that can be controlled by the controller, and possible to keep the media stop position within a designated range. Also, when the ratio of the circumferential length of the drive roller and the length of the nozzle row along the sub scan direction is a non-integral multiple, it is possible to convey the media with higher precision by the controller performing roller eccentricity error correction.

As shown in FIG. 2, the paper P is conveyed to the pair of conveyance rollers 54 via a fifth conveyance driven roller 52 and a third conveyance driven roller 48 abutting the roller 40 along the media conveyance path 34 with the conveyance unit 36, and a second conveyance driven roller 46 and a first conveyance driven roller 44 abutting the second roller 42. The recording unit 38 is provided at the downstream side of the media conveyance path 34 of the pair of conveyance rollers 54 of the conveyance unit 36.

Also, with this embodiment, the roller 40 and the roller 42 are set to the same diameter dimension. Because of that, it is possible to constitute the roller 40 and the roller 42 using a common member, and possible to reduce costs. Also, since the roller 40 and the roller 42 have the same diameter, by setting the rotation count of both rollers to be the same, the circumferential speed of the roller outer circumference, specifically, the paper conveyance speed, can easily be made equal.

Also, since it is possible to make the paper conveyance speed equal with the roller 40 and the roller 42, there is no pulling force given to the paper P between the roller 40 and the roller 42, or there is no sag given. As a result, it is possible to convey the paper P well along the conveyance path.

Also, with this embodiment, the roller 40 and the roller 42 are provided at a position for which they overlap in the printer 10 height direction, so it is possible to keep the arrangement area dimension of the roller 40 and the roller 42 in the printer 10 height direction to a minimum.

With this embodiment, with the conveyance unit 36, the conveyance paths of the paper P supplied from the front surface manual insertion unit 24, the back surface feed unit 26, and the media housing unit 28 jointly flow to the conveyance unit 36 at nip points NP1 (fourth conveyance driven roller 50 position), NP2 (first conveyance driven roller 44 position), and NP3 (fifth conveyance driven roller 52 position) which are mutually different joint flow positions, and the reverse transmission path from the pair of conveyance rollers 54 jointly flows to the conveyance unit 36 via any of nip points NP1, NP2, and NP3, so it is also possible for the media conveyance paths to be in common as the media conveyance path with the conveyance unit 36. Therefore, it is possible to have each media conveyance path from the front surface manual insertion unit 24, the back surface feed unit 26, and the media housing unit 28 be one media conveyance path, so it is possible to simplify the structure of the conveyance unit 36. As a result, it is possible to make the space occupied by the conveyance unit 36 in the printer 10 smaller.

Also, by having the joint flow position of each media supply path of the front surface manual insertion unit 24, the back surface feed unit 26, and the media housing unit 28 be at mutually different positions, it is possible to have conveyance of many types of paper P of different lengths in the conveyance direction and stiffness be performed at the joint flow position suited to the respective paper P. As a result, it is possible to execute processing of various diverse types of paper P with the printer 10, and possible to improve the ease of use of that printer 10.

Also, with this embodiment, the constitution is such that the media supply path 34*a* from the media housing unit 28 is made to jointly flow to the media conveyance path via the nip point NP3 positioned at the curved part 57 between the nip point NP1 and the nip point NP2. Here, by the paper P supplied from the media housing unit 28 being jointly flowed to the media conveyance path at the nip point NP3, the conveyance direction of the paper P is changed along the curved part 57. As a result, the paper P is conveyed smoothly toward the recording unit 38 along the media conveyance path. Therefore, the conveyance direction of the paper P supplied from the media housing unit 28 is changed along the curved part 57 from the nip point NP3, so it is possible to convey it smoothly toward the recording unit 38.

Also, with this embodiment, the media housing unit 28 is constituted as a paper feed cassette, so the media supply path 34*a* from the media housing unit 28 has the highest use frequency. With this embodiment, with the media conveyance path 34 that has the highest use frequency, it is possible to make joint flow from the media supply path 34*a* from the media housing unit 28 to the media conveyance path smooth, and possible to smoothly change the conveyance direction of the conveyed paper P. Therefore, it is possible to suppress the occurrence of paper jams and conveyance failures in the conveyance path 34 of the paper P with the recording unit 38 from the media housing unit 28.

With this embodiment, the device main unit 12 of the present invention was applied to an inkjet printer as an example of a recording device, but it is also possible to apply it to other commonly used liquid spray devices. Here, the liquid spray device is not limited to being a recording device such as a printer, copy machine, fax machine or the like for which an inkjet type recording head is used, ink is discharged from that recording head, and recording is performed on the media to be recorded, but also includes devices for which instead of ink, the liquid corresponding to that application is sprayed on a media to be sprayed correlating to the media to be recorded from a liquid spray head corresponding to the inkjet type recording head, and the liquid is adhered to the media to be sprayed.

As the liquid spray head, in addition to the recording head, examples include a coloring material spray head used with color filter manufacturing such as of liquid crystal displays or the like, an electrode material (conductive paste) spray head used for electrode formation such as of an organic EL display, a surface light emitting display (FED) or the like, a bioorganic material spray head used with biochip manufacturing, a sample spray head as a precision pipette or the like.

The present invention is not limited to the embodiments noted above, and it goes without saying that it is possible to have various modifications within the scope of the invention noted in the patent claims, and that those items are also included within the scope of the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A serial inkjet printer, comprising:

a recording head having a plurality of nozzles between which a pitch is X inches;

a carriage configured to move the recording head;

a cut paper unit configured to store a cut paper as a medium;

a first roller pair configured to move the medium at an upstream side of a conveyance direction of the medium relative to the recording head; and a second roller pair configured to move the medium at a downstream side of the conveyance direction relative to the recording head, the first roller pair including a drive roller and a driven roller, the drive roller having a hollow structure, a circumferential length Y of the drive roller, when a length along the conveyance direction of a row formed by the plurality of the nozzles is Z inches, Y being greater than Z, while repeating scanning of the recording head and conveying of the medium, recording being performed in band units at a printing speed of 20 ipm or more, and stop error precision of the medium during conveyance being X/2 inches or less.

2. The serial inkjet printer according to claim 1, wherein the length along the conveyance direction of the row formed by the plurality of the nozzles is 1 to 2 inches.

3. The serial inkjet printer according to claim 1, further comprising a DC servo motor configured to drive the drive roller, and a controller configured to control the DC servo motor, wherein the controller is configured to control the DC servo motor such that the stop error precision of the medium during the conveyance is X/2 inches or less.

4. The serial inkjet printer according to claim 3, wherein a ratio of Y and Z is a non-integral multiple, and the controller is configured to perform eccentricity correction of the drive roller.

* * * * *